US010684050B2

(12) United States Patent
Ohura et al.

(10) Patent No.: US 10,684,050 B2
(45) Date of Patent: Jun. 16, 2020

(54) REFRIGERATION APPARATUS WITH DEFROST OPERATION FOR PARALLEL OUTDOOR UNITS

(71) Applicant: DAIKIN INDUSTRIES, LTD., Osaka-shi, Osaka (JP)

(72) Inventors: Ryuuta Ohura, Osaka (JP); Takuya Kotani, Osaka (JP); Junya Minami, Osaka (JP)

(73) Assignee: DAIKIN INDUSTRIES, LTD., Osaka-Shi (JP)

( * ) Notice: Subject to any disclaimer, the term of this patent is extended or adjusted under 35 U.S.C. 154(b) by 45 days.

(21) Appl. No.: 16/070,101

(22) PCT Filed: Jan. 11, 2017

(86) PCT No.: PCT/JP2017/000647
§ 371 (c)(1),
(2) Date: Jul. 13, 2018

(87) PCT Pub. No.: WO2017/122685
PCT Pub. Date: Jul. 20, 2017

(65) Prior Publication Data

US 2019/0032978 A1 Jan. 31, 2019

(30) Foreign Application Priority Data

Jan. 15, 2016 (JP) ..... 2016-005926

(51) Int. Cl.
*F25B 47/02* (2006.01)
*F24F 11/89* (2018.01)
(Continued)

(52) U.S. Cl.
CPC ..... *F25B 47/02* (2013.01); *F24F 11/42* (2018.01); *F24F 11/88* (2018.01); *F24F 11/89* (2018.01);
(Continued)

(58) Field of Classification Search
CPC ..... F25B 47/025; F25B 2313/0251; F25B 2313/02531; F25B 2313/0292; F25B 2313/02542; F25B 2347/021
See application file for complete search history.

(56) References Cited

U.S. PATENT DOCUMENTS 4,770,000 A * 9/1988 Kuroda ..... F25B 13/00 62/156
2005/0044861 A1 3/2005 Cho
(Continued)

FOREIGN PATENT DOCUMENTS

JP 7-332815 A 12/1995
JP 2008-25919 A 2/2008
(Continued)

OTHER PUBLICATIONS

International Search Report, issued in PCT/JP2017/000647, PCT/ISA/210, dated Apr. 4, 2017.

*Primary Examiner* — Jonathan Bradford
(74) *Attorney, Agent, or Firm* — Birch, Stewart, Kolasch & Birch, LLP

(57) ABSTRACT

Provided is a refrigeration apparatus in which adverse events caused by excess refrigerant can be suppressed even when defrosting is performed with some of a plurality of outdoor units designated as units to be defrosted. An air-conditioning apparatus is configured from a parallel connection of a first outdoor unit and a second outdoor unit, wherein when a second outdoor heat exchanger of the second outdoor unit is caused to function as an evaporator while a first outdoor heat exchanger of the first outdoor unit is caused to function as a condenser to defrost the first outdoor heat exchanger, a refrigerant circuit has a flow channel that supplies some of the refrigerant flowing out of the first outdoor heat exchanger to the second outdoor heat exchanger and a flow
(Continued)

channel that supplies the rest of the refrigerant flowing out of the first outdoor heat exchanger to an indoor heat exchanger.

8 Claims, 6 Drawing Sheets

(51) Int. Cl.

| | |
|---|---|
| ***F25B 13/00*** | (2006.01) |
| ***F25B 49/02*** | (2006.01) |
| ***F24F 11/88*** | (2018.01) |
| ***F24F 11/42*** | (2018.01) |
| ***F25B 41/04*** | (2006.01) |

(52) U.S. Cl.

CPC ..... *F25B 13/00* (2013.01); *F25B 41/04* (2013.01); *F25B 47/025* (2013.01); *F25B 49/02* (2013.01); *F25B 49/027* (2013.01); *F25B 2313/0233* (2013.01); *F25B 2313/0251* (2013.01); *F25B 2313/0292* (2013.01); *F25B 2313/02531* (2013.01); *F25B 2313/02533* (2013.01); *F25B 2313/02542* (2013.01); *F25B 2313/0315* (2013.01); *F25B 2400/075* (2013.01); *F25B 2600/2513* (2013.01); *F25B 2700/1931* (2013.01); *F25B 2700/1933* (2013.01); *F25B 2700/2106* (2013.01); *F25B 2700/21151* (2013.01); *F25B 2700/21152* (2013.01)

(56) References Cited

U.S. PATENT DOCUMENTS

2012/0266616 A1* 10/2012 Lee ..... F25B 13/00 62/80
2015/0059373 A1* 3/2015 Maiello ..... F25B 49/022 62/115

FOREIGN PATENT DOCUMENTS

JP 2015-183898 A 10/2015
WO WO 2015/161461 A1 10/2015

* cited by examiner

REFRIGERATION APPARATUS WITH DEFROST OPERATION FOR PARALLEL OUTDOOR UNITS

TECHNICAL FIELD

The present invention relates to a refrigeration apparatus.

BACKGROUND ART

Conventionally, for refrigeration apparatuses in which a plurality of outdoor units are connected in parallel to an indoor unit, operation methods have been proposed in which defrosting is performed in outdoor heat exchangers of some outdoor units to be defrosted, and the outdoor heat exchangers of the outdoor units are entirely defrosted while the units designated for defrosting are changed, as in, e.g., the air-conditioning apparatus disclosed in Patent Literature 1 (Japanese Laid-open Patent Publication No. 2008-25919).

SUMMARY OF THE INVENTION

Technical Problem

In this case, in the air-conditioning apparatus disclosed in the aforementioned Patent Literature 1, an indoor expansion valve provided to the indoor unit is maintained in a fully closed state during defrosting. Therefore, during the defrost operation, refrigerant does not flow to the indoor unit side and refrigerant will flow solely between the outdoor units alone.

However, given that sealed within a refrigerant circuit is a refrigerant amount adequate for the entire refrigerant circuit including both the outdoor unit side and the indoor unit side, and when defrosting is performed with refrigerant being circulated only between the outdoor units, the operation is one performed only between the outdoor units within the entire refrigerant circuit, and there is likely to be excess refrigerant within the refrigerant circuit.

When there is excess refrigerant in this manner, refrigerant accumulates in an outdoor heat exchanger to be defrosted, and it is sometimes difficult to efficiently perform defrosting.

On the other hand, when the excess refrigerant is to be processed by an accumulator on an intake side of a compressor connected to an outdoor heat exchanger functioning as a condenser, the inside of the accumulator is likely to be immediately filled with refrigerant because refrigerant does not flow toward the indoor heat exchanger side and refrigerant returns immediately from another outdoor unit. Moreover, due to switching of four-way switching valves after defrosting has ended, a large amount of liquid refrigerant flows in to the accumulator, in which a large amount of liquid refrigerant has already accumulated, from an outdoor heat exchanger in which a large amount of liquid refrigerant has already accumulated due to the outdoor heat exchanger functioning as a condenser, which creates a risk that liquid refrigerant will overflow from the accumulator and be taken into the compressor. Additionally, it sometimes becomes necessary to increase the size of the accumulator in order to suppress overflowing of liquid refrigerant from the accumulator. The present invention was devised in view of the matters described above, it being an object of the present invention to provide a refrigeration apparatus in which adverse events caused by excess refrigerant can be suppressed even when defrosting is performed with some of a plurality of outdoor units designated as units to be defrosted.

Solution to Problem

A refrigeration apparatus according to a first aspect is configured from a parallel connection of a plurality of outdoor units to an indoor unit, the refrigeration apparatus comprising a refrigerant circuit and a control unit. The refrigerant circuit is configured from a connection of an indoor heat exchanger and indoor expansion valve provided to the indoor unit, and outdoor heat exchangers, compressors, and switching valves provided to the respective outdoor units. The control unit has a partial defrost mode in which an operation is performed with the switching valves having been switched so that the outdoor heat exchangers of some of the plurality of outdoor units are caused to function as evaporators while the outdoor heat exchangers of the rest of the plurality of outdoor units are caused to function as condensers, whereby the outdoor heat exchangers functioning as the condensers are designated as components to be defrosted. The refrigerant circuit, during execution of the partial defrost mode, has a flow channel that supplies some of the refrigerant flowing out of the outdoor heat exchangers functioning as condensers to the outdoor heat exchangers functioning as evaporators, and a flow channel that supplies the rest of the refrigerant flowing out of the outdoor heat exchangers functioning as condensers to the indoor heat exchanger. The refrigerant circuit during execution of the partial defrost mode does not need to constantly have a flow channel that supplies the rest of the refrigerant flowing out of the outdoor heat exchangers functioning as condensers to the indoor heat exchanger (the indoor expansion valve does not always need to be open), but it is desirable to ensure there is a state in which the refrigerant circuit at least has the above-described flow channel at any timing from the start to end of the partial defrost mode. When the refrigerant circuit is in a state of having at least the above-described flow channel, a state is ensured in which refrigerant flows in the indoor heat exchanger and/or the indoor expansion valve, and the effects of the present invention are achieved.

In this refrigeration apparatus, when the partial defrost mode is executed, in which some of the plurality of outdoor units are designated to be defrosted, the refrigerant circuit has a flow channel that supplies some of the refrigerant flowing out of the outdoor heat exchangers functioning as condensers to the outdoor heat exchangers functioning as evaporators, and a flow channel that supplies the rest of the refrigerant flowing out of the outdoor heat exchangers functioning as condensers to the indoor heat exchanger. Therefore, in the refrigerant circuit, refrigerant can be channeled in the indoor heat exchanger and/or the indoor expansion valve, and refrigerant can also be channeled in tubes interconnecting the indoor unit and the plurality of outdoor units. In this partial defrost mode, the outdoor heat exchangers that are not to be defrosted are caused to function as evaporators of refrigerant at a low pressure and the indoor heat exchanger is caused to function as an evaporator at an intermediate pressure, which is the pressure once the low-pressure refrigerant has been compressed (the pressure of the refrigerant compressed by the compressors connected to the outdoor heat exchangers that are not to be defrosted), whereby the evaporation of refrigerant in the indoor heat exchanger can be suppressed to a smaller amount than when only the indoor heat exchanger is caused to function as an evaporator of the refrigerant at a low pressure. It is thereby possible to suppress the temperature decrease in the indoor heat exchanger and to shorten the time needed until warm air is blown out when an air-warming operation is restarted. Thus, during execution of the partial defrost mode, in which refrigerant flows not only between the outdoor units but also in the indoor unit, excess refrigerant in the refrigerant circuit is readily absorbed at these locations. Additionally, due to the excess refrigerant in the refrigerant circuit being absorbed in these locations, it is possible to avoid situations in which refrigerant flowing out from the outdoor units to be defrosted returns immediately to the same outdoor units, and there is no need to employ a large accumulator for processing the excess refrigerant. Additionally, the refrigerant flowing out from the outdoor units to be defrosted flows not only toward the outdoor units that are not to be defrosted, but also toward the indoor unit; therefore, accumulation of liquid refrigerant in the outdoor heat exchangers to be defrosted can be suppressed, and defrosting can be performed efficiently.

Thus, even when defrosting is performed with some of the plurality of outdoor units designated for defrosting, it is possible to suppress adverse events caused by excess refrigerant.

A refrigeration apparatus according to a second aspect is the refrigeration apparatus according to the first aspect, wherein the refrigerant circuit, during execution of the partial defrost mode, has a flow channel that supplies refrigerant that has passed through the indoor heat exchanger to intake sides of the compressors of the outdoor units having the outdoor heat exchangers functioning as condensers. The control unit executes an indoor expansion valve opening degree adjustment mode of performing opening degree control for the indoor expansion valve so that a degree of superheating of refrigerant in the compressors of the outdoor units having the outdoor heat exchangers functioning as condensers meets a predetermined degree of superheating condition.

Cases in which the degree of superheating of the refrigerant in the compressors of the outdoor units having the outdoor heat exchangers functioning as condensers meets the predetermined degree of superheating condition include both cases in which the degree of superheating of the refrigerant taken in by the compressors of the outdoor units having the outdoor heat exchangers functioning as condensers meets the predetermined degree of superheating condition, and cases in which the degree of superheating of the refrigerant discharged by the compressors of the outdoor units having the outdoor heat exchangers functioning as condensers meets the predetermined degree of superheating condition.

In this refrigeration apparatus, when the partial defrost mode is executed, in cases in which the refrigerant that has passed through the indoor heat exchanger is supplied to the intake sides of the compressors of the outdoor units having the outdoor heat exchangers that are to be defrosted, opening degree control for the indoor expansion valve is performed so that the degree of superheating of the refrigerant in the compressors of the outdoor units to be defrosted meets the predetermined degree of superheating condition. Therefore, even in cases in which excess refrigerant is absorbed by opening the indoor expansion valve to ensure a state in which refrigerant flows in the indoor heat exchanger, etc., the refrigerant amount sent from the indoor unit to the outdoor units to be defrosted can be controlled, and it is therefore possible to suppress the incidence of liquid compression and/or the incidence of abnormal increases in the discharged refrigerant temperature in the compressors of the outdoor units having the outdoor heat exchangers to be defrosted.

A refrigeration apparatus according to a third aspect is the refrigeration apparatus according to the second aspect, wherein the control unit performs control that fixes the opening degree of the indoor expansion valve at a predetermined opening degree from the time the partial defrost mode starts until a time before the start of the indoor expansion valve opening degree adjustment mode.

There are no particular limitations as to this predetermined opening degree; for example, it may be preestablished as an opening degree corresponding to the capacity of the indoor heat exchanger to which the indoor expansion valve to be controlled is directly connected.

In this refrigeration apparatus, from the start of the partial defrost mode until a time before the start of the indoor expansion valve opening degree adjustment mode, the indoor expansion valve is fixed at a predetermined opening degree so that refrigerant can pass through. Therefore, refrigerant flow in the indoor expansion valve and/or the indoor heat exchanger immediately after the start of the partial defrost mode is reliably ensured, whereby accumulation of refrigerant in the outdoor heat exchangers to be defrosted can be effectively suppressed.

A refrigeration apparatus according to a fourth aspect is the refrigeration apparatus according to either the second or third aspect, wherein the refrigerant circuit, during execution of the partial defrost mode, has a flow channel that supplies refrigerant that has passed through the outdoor heat exchangers functioning as evaporators to the intake sides of the compressors of the outdoor units having the outdoor heat exchangers functioning as condensers via the compressors of the outdoor units having the outdoor heat exchangers functioning as evaporators.

In this refrigeration apparatus, refrigerant can be compressed in multiple stages, with the compressors of the outdoor units that are not to be defrosted as low-stage-side compressors and the compressors of the outdoor units that are to be defrosted as high-stage-side compressors. Because high-temperature refrigerant thus compressed in multiple stages can be supplied to the outdoor heat exchangers that are to be defrosted, defrosting can be performed efficiently.

In the refrigeration apparatus of the fourth aspect, in a relationship with the refrigeration apparatus according to the second or third aspect, in cases in which not only refrigerant sent from the indoor unit but also refrigerant sent from the outdoor units that are not to be defrosted is supplied to the outdoor units to be defrosted, it is possible to control the opening degree of the indoor expansion valve so that liquid compression and/or abnormal increases in the discharge temperature do not occur in the compressors of the outdoor units to be defrosted.

A refrigeration apparatus according to a fifth aspect is the refrigeration apparatus according to any of the first through fourth aspects, wherein, when a predetermined defrosting ending condition has been fulfilled for the outdoor heat exchangers to be defrosted, the control unit switches the switching valves and performs an operation so that the outdoor heat exchangers that had been designated to be defrosted are caused to function as evaporators while the designation of outdoor heat exchangers to be defrosted is changed to other outdoor heat exchangers.

In this refrigeration apparatus, when the predetermined defrosting condition has been fulfilled, defrosting can be performed with the plurality of outdoor heat exchangers sequentially designated for defrosting. In this aspect, when defrosting of a certain outdoor heat exchanger to be defrosted ends and the air-warming operation is immediately restarted, there is a risk that the air-warming operation will be frequently halted by the defrost operation due to, inter alia, the predetermined defrosting condition being fulfilled for another outdoor heat exchanger immediately after the air-warming operation is restarted. To address this problem, in this refrigeration apparatus, it is possible to suppress the frequency with which the air-warming operation is halted by the defrost operation.

Effects of the Invention

With the refrigeration apparatus according to the first aspect, it is possible to suppress adverse events caused by excess refrigerant even when defrosting is performed with some of the plurality of outdoor units designated for defrosting.

With the refrigeration apparatus according to the second aspect, it is possible to suppress the incidence of liquid compression and/or the incidence of abnormal increases in the discharged refrigerant temperature in the compressors of the outdoor units having the outdoor heat exchangers to be defrosted.

With the refrigeration apparatus according to the third aspect, immediately after the start of the partial defrost mode, it is possible to effectively suppress refrigerant accumulation in the outdoor heat exchangers to be defrosted.

With the refrigeration apparatus according to the fourth aspect, defrosting can be efficiently performed.

With the refrigeration apparatus according to the fifth aspect, it is possible to suppress the frequency with which the air-warming operation is halted by the defrost operation.

DESCRIPTION OF EMBODIMENTS

Below is a description, made with reference to the drawings, of an embodiment in which the refrigeration apparatus of the present invention is employed.

(1) Overall General Configuration

Figure 1:
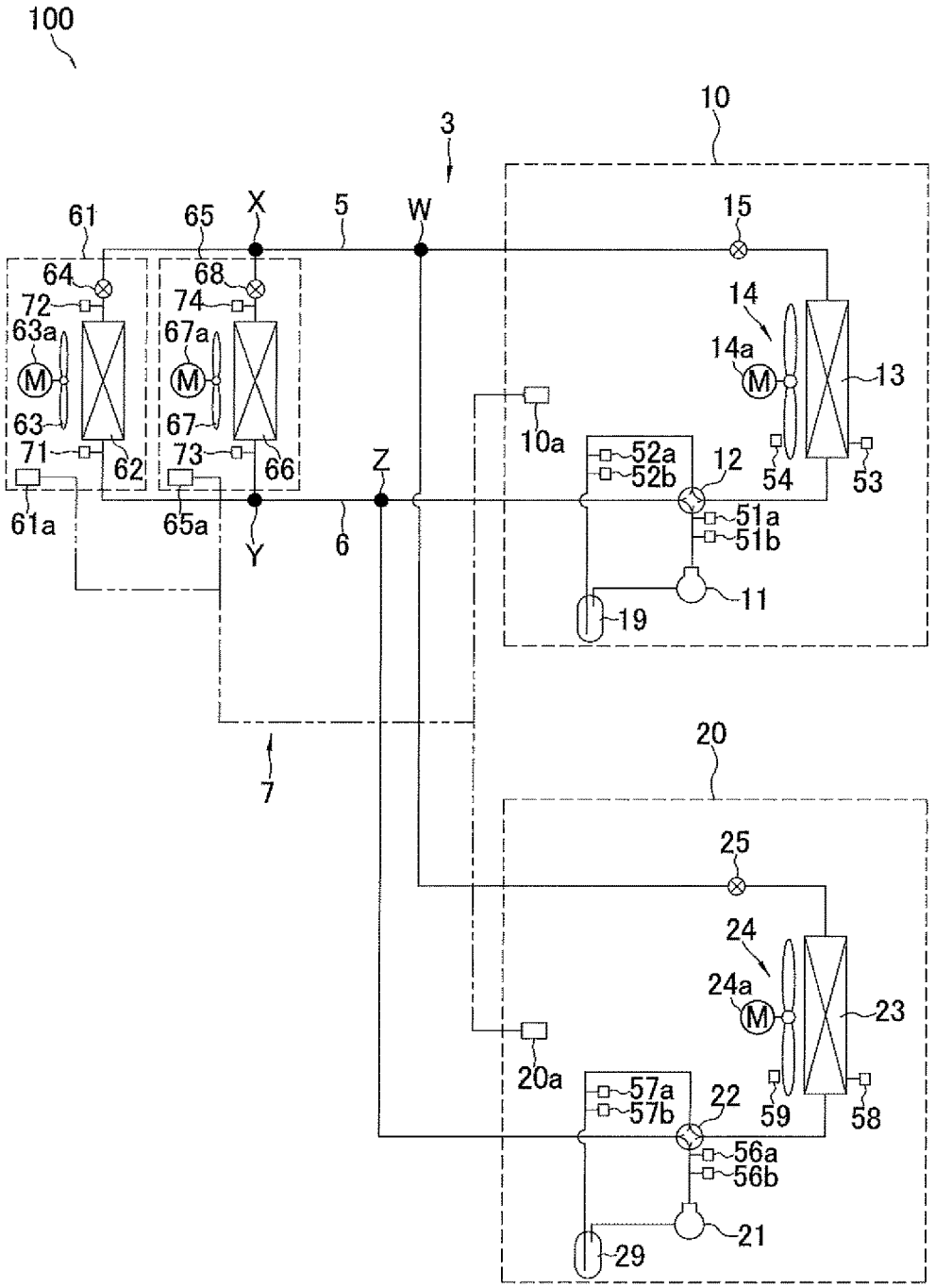
FIG. 1 is a refrigerant circuit diagram of an air-conditioning apparatus.
Figure 2:
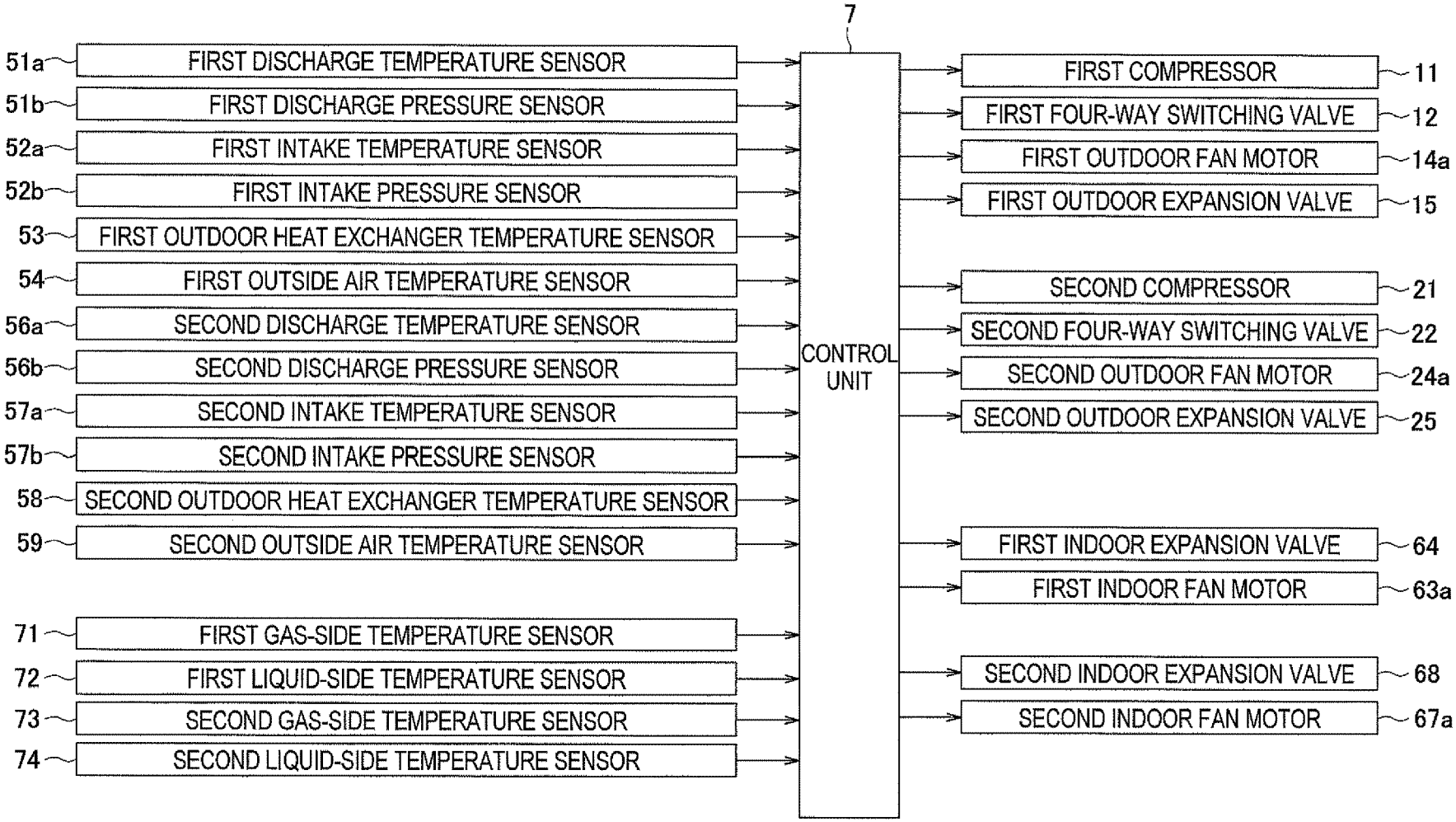
FIG. 2 is a block configuration diagram of the air-conditioning apparatus.

FIG. 1 shows a refrigerant circuit diagram of an air-conditioning apparatus 100. FIG. 2 shows a block configuration diagram of the air-conditioning apparatus 100.

The air-conditioning apparatus 100 of the present embodiment is provided with a first outdoor unit 10, a second outdoor unit 20, a first indoor unit 61, and a second indoor unit 65.

The first outdoor unit 10, the second outdoor unit 20, the first indoor unit 61, and the second indoor unit 65 configure a refrigerant circuit 3 by being connected to each other via a liquid-side refrigerant interconnection tube 5 and a gas-side refrigerant interconnection tube 6. In the refrigerant circuit 3 of the present embodiment, the first indoor unit 61 and the second indoor unit 65 are connected in parallel to the first outdoor unit 10 and the second outdoor unit 20 via the liquid-side refrigerant interconnection tube 5 and the gas-side refrigerant interconnection tube 6. Additionally, the first outdoor unit 10 and the second outdoor unit 20 are connected in parallel to the first indoor unit 61 and the second indoor unit 65 via the liquid-side refrigerant interconnection tube 5 and the gas-side refrigerant interconnection tube 6.

Working refrigerant is sealed within the refrigerant circuit 3 so that a refrigeration cycle can be carried out.

The air-conditioning apparatus 100 is operably controlled and/or monitored by a control unit 7. In this embodiment, a first indoor-side control board 61*a* provided to the first indoor unit 61, a second indoor-side control board 65*a* provided to the second indoor unit 65, a first outdoor-side control board 10*a* provided to the first outdoor unit 10, and a second outdoor-side control board 20*a* provided to the second outdoor unit 20 are connected so as to be capable of intercommunicating, thereby configuring the control unit 7.

(2) First Indoor Unit 61

The first indoor unit 61 has a first indoor heat exchanger 62, a first indoor expansion valve 64, a first indoor fan 63, a first indoor fan motor 63*a*, a first gas-side temperature sensor 71, and a first liquid-side temperature sensor 72.

The first indoor heat exchanger 62 configures part of the refrigerant circuit 3. A gas-side end of the first indoor heat exchanger 62 is connected with a refrigerant tube extending from a point Y, which is an end of the gas-side refrigerant interconnection tube 6 to be described hereinafter. A liquid-side end of the first indoor heat exchanger 62 is connected with a refrigerant tube extending from a point X, which is an end of the liquid-side refrigerant interconnection tube 5 to be described hereinafter.

The first indoor expansion valve 64 is provided to the liquid side of the first indoor heat exchanger 62 (specifically, partway along the refrigerant tube joining point X and the liquid-side end of the first indoor heat exchanger 62) within the refrigerant circuit 3. There are no particular limitations as to the first indoor expansion valve 64; for example, the valve can be an electric expansion valve of which the valve opening degree can be adjusted in order to adjust the amount and/or degree of decompression of the refrigerant flowing therethrough.

The first indoor fan 63 forms an air flow that sends air in a space to be air-conditioned (indoors) to the first indoor heat exchanger 62 and returns air that has passed through the first indoor heat exchanger 62 back to the space to be air-conditioned. The airflow volume of the first indoor fan 63 is adjusted due to the first indoor fan motor 63*a* being drivably controlled.

The first gas-side temperature sensor 71, which is attached to a refrigerant tube between point Y of the gas-side refrigerant interconnection tube 6 and a gas side of the first indoor heat exchanger 62, senses the temperature of the refrigerant passing through the gas-side end of the first indoor heat exchanger 62.

The first liquid-side temperature sensor 72, which is attached to a refrigerant tube between the first indoor expansion valve 64 and the liquid side of the first indoor heat exchanger 62, senses the temperature of the refrigerant passing through a liquid-side end of the first indoor heat exchanger 62.

The first indoor-side control board 61*a*, which configures part of the control unit 7 described above, is provided to the first indoor unit 61. The first indoor-side control board 61*a*, which is configured having a CPU, a ROM, a RAM, etc., controls the valve opening degree of the first indoor expansion valve 64, controls the airflow volume of the first indoor fan 63 via the first indoor fan motor 63*a*, ascertains the temperature sensed by the first gas-side temperature sensor 71, ascertains the temperature sensed by the first liquid-side temperature sensor 72, etc.

(3) Second Indoor Unit 65

The second indoor unit 65, which is similar to the first indoor unit 61, has a second indoor heat exchanger 66, a second indoor expansion valve 68, a second indoor fan 67, a second indoor fan motor 67*a*, a second gas-side temperature sensor 73, and a second liquid-side temperature sensor 74.

The second indoor heat exchanger 66 configures part of the refrigerant circuit 3. A gas-side end of the second indoor heat exchanger 66 is connected with a refrigerant tube (separate from the refrigerant tube extending to the first indoor heat exchanger 62) extending from point Y, which is the end of the gas-side refrigerant interconnection tube 6 (described hereinafter). A liquid-side end of the second indoor heat exchanger 66 is connected with a refrigerant tube (separate from the refrigerant tube extending to the first indoor heat exchanger 62) extending from point X, which is the end of the liquid-side refrigerant interconnection tube 5 to be described hereinafter.

The second indoor expansion valve 68 is provided to the liquid side of the second indoor heat exchanger 66 (specifically, midway through the refrigerant tube joining point X and the liquid-side end of the second indoor heat exchanger 66) within the refrigerant circuit 3. There are no particular limitations as to the second indoor expansion valve 68; for example, the valve can be an electric expansion valve of which the valve opening degree can be adjusted in order to adjust the amount and/or degree of decompression of the refrigerant flowing therethrough, in the same manner as the first indoor expansion valve 64.

The second indoor fan 67 forms an air flow that sends air in a space to be air-conditioned (indoors) to the second indoor heat exchanger 66 and returns air that has passed through the second indoor heat exchanger 66 back to the space to be air-conditioned. The airflow volume of the second indoor fan 67 is adjusted due to the second indoor fan motor 67*a* being drivably controlled.

The second gas-side temperature sensor 73, which is attached to a refrigerant tube between point Y of the gas-side refrigerant interconnection tube 6 and a gas side of the second indoor heat exchanger 66, senses the temperature of the refrigerant passing through the gas-side end of the second indoor heat exchanger 66.

The second liquid-side temperature sensor 74, which is attached to a refrigerant tube between the second indoor expansion valve 68 and the liquid side of the second indoor heat exchanger 66, senses the temperature of the refrigerant passing through a liquid-side end of the second indoor heat exchanger 66.

The second indoor-side control board 65*a*, which configures part of the control unit 7 described above, is provided to the second indoor unit 65. The second indoor-side control board 65*a*, which is configured having a CPU, a ROM, a RAM, etc., controls the valve opening degree of the second indoor expansion valve 68, controls the airflow volume of the second indoor fan 67 via the second indoor fan motor 67*a*, ascertains the temperature sensed by the second gas-side temperature sensor 73, ascertains the temperature sensed by the second liquid-side temperature sensor 74, etc.

(4) First Outdoor Unit 10

The first outdoor unit 10 has a first compressor 11, a first four-way switching valve 12, a first outdoor heat exchanger 13, a first outdoor fan 14, a first outdoor fan motor 14*a*, a first outdoor expansion valve 15, a first accumulator 19, a first discharge temperature sensor 51*a*, a first discharge pressure sensor 51*b*, a first intake temperature sensor 52*a*, a first intake pressure sensor 52*b*, a first outdoor heat exchanger temperature sensor 53, and a first outside air temperature sensor 54.

The first compressor 11 is a compressor of which the frequency can be controlled and the operating capacity can be varied.

The first four-way switching valve 12 has four connection ports, of which two are connected to each other and the other two are connected to each other. The first outdoor unit 10 can be switched between an air-cooling operation state and an air-warming operation state by switching the connection state of the first four-way switching valve 12. In the air-cooling operation state of the first outdoor unit 10, the first four-way switching valve 12 is switched so that an intake side of the first compressor 11 leads to the gas-side refrigerant interconnection tube 6 and the refrigerant discharged from the first compressor 11 is channeled to the first outdoor heat exchanger 13. In the air-warming operation state of the first outdoor unit 10, the first four-way switching valve 12 is switched so that the intake side of the first compressor 11 leads to the first outdoor heat exchanger 13 and the refrigerant discharged from the first compressor 11 is channeled to the gas-side refrigerant interconnection tube 6.

The first outdoor heat exchanger 13 can function as a refrigerant heat radiator (condenser) when the first outdoor unit 10 is in the air-cooling operation state and can function as a refrigerant evaporator when the first outdoor unit 10 is in the air-warming operation state. There are no particular limitations as to the first outdoor heat exchanger 13; for example, this heat exchanger is configured from a plurality of heat transfer fins and heat transfer tubes.

The first outdoor fan 14 rotates due to the driving of the first outdoor fan motor 14*a* and supplies outdoor air to the first outdoor heat exchanger 13.

The first outdoor expansion valve 15 is provided to a liquid side of the first outdoor heat exchanger 13 (between the liquid side of the first outdoor heat exchanger 13 and the liquid-side refrigerant interconnection tube 5). There are no particular limitations as to the first outdoor expansion valve 15; for example, the valve can be an electric expansion valve of which the amount and/or degree of decompression of the refrigerant flowing therethrough can be adjusted.

The first accumulator 19 is a refrigerant container provided between one connection port of the first four-way switching valve 12 and the intake side of the first compressor 11.

The first discharge temperature sensor 51*a* senses the temperature of the refrigerant flowing between a discharge side of the first compressor 11 and one connection port of the first four-way switching valve 12.

The first discharge pressure sensor 51*b* senses the pressure of the refrigerant flowing between the discharge side of the first compressor 11 and one connection port of the first four-way switching valve 12.

The first intake temperature sensor 52*a* senses the temperature of the refrigerant flowing between the intake side of the first compressor 11 and one connection port of the first four-way switching valve 12.

The first intake pressure sensor 52*b* senses the pressure of the refrigerant flowing between the intake side of the first compressor 11 and one connection port of the first four-way switching valve 12.

The first outdoor heat exchanger temperature sensor 53 senses the temperature of the refrigerant flowing through the first outdoor heat exchanger 13.

The first outside air temperature sensor 54 senses the temperature of outdoor air, before the outdoor air passes through the first outdoor heat exchanger 13, as an outside air temperature.

The first outdoor-side control board 10*a*, which configures part of the control unit 7 described above, is provided to the first outdoor unit 10. The first outdoor-side control board 10*a*, which is configured having a CPU, a ROM, a RAM, etc., controls the drive frequency of the first compressor 11, switches the connection state of the first four-way switching valve 12, controls the airflow volume of the first outdoor fan 14 via the first outdoor fan motor 14*a*, controls the valve opening degree of the first outdoor expansion valve 15, ascertains the temperature sensed by the first discharge temperature sensor 51*a*, ascertains the temperature sensed by the first discharge pressure sensor 51*b*, ascertains the temperature sensed by the first intake temperature sensor 52*a*, ascertains the temperature sensed by the first intake pressure sensor 52*b*, ascertains the temperature sensed by the first outdoor heat exchanger temperature sensor 53, ascertains the temperature sensed by the first outside air temperature sensor 54, etc.

(5) Second Outdoor Unit 20

The second outdoor unit 20 is configured in a manner similar to the first outdoor unit 10, as is described below.

The second outdoor unit 20 has a second compressor 21, a second four-way switching valve 22, a second outdoor heat exchanger 23, a second outdoor fan 24, a second outdoor fan motor 24*a*, a second outdoor expansion valve 25, a second accumulator 29, a second discharge temperature sensor 56*a*, a second discharge pressure sensor 56*b*, a second intake temperature sensor 57*a*, a second intake pressure sensor 57*b*, a second outdoor heat exchanger temperature sensor 58, and a second outside air temperature sensor 59.

The second compressor 21 is a compressor of which the frequency can be controlled and the operating capacity can be varied.

The second four-way switching valve 22 has four connection ports, of which two are connected to each other and the other two are connected to each other. The second outdoor unit 20 can be switched between an air-cooling operation state and an air-warming operation state by switching the connection state of the second four-way switching valve 22. In the air-cooling operation state of the second outdoor unit 20, the second four-way switching valve 22 is switched so that an intake side of the second compressor 21 leads to the gas-side refrigerant interconnection tube 6 and the refrigerant discharged from the second compressor 21 is channeled to the second outdoor heat exchanger 23. In the air-warming operation state of the second outdoor unit 20, the second four-way switching valve 22 is switched so that the intake side of the second compressor 21 leads to the second outdoor heat exchanger 23 and the refrigerant discharged from the second compressor 21 is channeled to the gas-side refrigerant interconnection tube 6.

The second outdoor heat exchanger 23 can function as a refrigerant heat radiator (condenser) when the second outdoor unit 20 is in the air-cooling operation state and can function as a refrigerant evaporator when the second outdoor unit 20 is in the air-warming operation state. There are no particular limitations as to the second outdoor heat exchanger 23; for example, this heat exchanger is configured from a plurality of heat transfer fins and heat transfer tubes.

The second outdoor fan 24 rotates due to the driving of the second outdoor fan motor 24*a* and supplies outdoor air to the second outdoor heat exchanger 23.

The second outdoor expansion valve 25 is provided to a liquid side of the second outdoor heat exchanger 23 (between the liquid side of the second outdoor heat exchanger 23 and the liquid-side refrigerant interconnection tube 5). There are no particular limitations as to the second outdoor expansion valve 25; for example, the valve can be an electric expansion valve of which the amount and/or degree of decompression of the refrigerant flowing therethrough can be adjusted.

The second accumulator 29 is a refrigerant container provided between one connection port of the second four-way switching valve 22 and the intake side of the second compressor 21.

The second discharge temperature sensor 56*a* senses the temperature of the refrigerant flowing between a discharge side of the second compressor 21 and one connection port of the second four-way switching valve 22.

The second discharge pressure sensor 56*b* senses the pressure of the refrigerant flowing between the discharge side of the second compressor 21 and one connection port of the second four-way switching valve 22.

The second intake temperature sensor 57*a* senses the temperature of the refrigerant flowing between the intake side of the second compressor 21 and one connection port of the second four-way switching valve 22.

The second intake pressure sensor 57*b* senses the pressure of the refrigerant flowing between the intake side of the second compressor 21 and one connection port of the second four-way switching valve 22.

The second outdoor heat exchanger temperature sensor 58 senses the temperature of the refrigerant flowing through the second outdoor heat exchanger 23.

The second outside air temperature sensor 59 senses the temperature of outdoor air, before the outdoor air passes through the second outdoor heat exchanger 23, as the outside air temperature.

The second outdoor-side control board 20*a*, which configures part of the control unit 7 described above, is provided to the second outdoor unit 20. The second outdoor-side control board 20*a*, which is configured having a CPU, a ROM, a RAM, etc., controls the drive frequency of the second compressor 21, switches the connection state of the second four-way switching valve 22, controls the airflow volume of the second outdoor fan 24 via the second outdoor fan motor 24*a*, controls the valve opening degree of the second outdoor expansion valve 25, ascertains the temperature sensed by the second discharge temperature sensor 56*a*, ascertains the temperature sensed by the second discharge pressure sensor 56*b*, ascertains the temperature sensed by the second intake temperature sensor 57*a*, ascertains the temperature sensed by the second intake pressure sensor 57*b*, ascertains the temperature sensed by the second outdoor heat exchanger temperature sensor 58, ascertains the temperature sensed by the second outside air temperature sensor 59, etc.

(6) Liquid-Side Refrigerant Interconnection Tube 5 and Gas-Side Refrigerant Interconnection Tube 6

The liquid-side refrigerant interconnection tube 5 and the gas-side refrigerant interconnection tube 6 connect the first indoor unit 61 and the second indoor unit 65 with the first outdoor unit 10 and the second outdoor unit 20.

The liquid-side refrigerant interconnection tube 5 connects point X, which is a merging point of a tube extending from the first indoor expansion valve 64 of the first indoor unit 61 to the liquid side and a tube extending from the second indoor expansion valve 68 of the second indoor unit 65 to the liquid side, and point W, which is a merging point of a tube extending from the first outdoor expansion valve 15 of the first outdoor unit 10 to the liquid side and a tube extending from the second outdoor expansion valve 25 of the second outdoor unit 20 to the liquid side. The liquid-side refrigerant interconnection tube 5 configures part of the refrigerant circuit 3.

The gas-side refrigerant interconnection tube 6 connects point Y, which is a merging point of a tube extending from the first indoor heat exchanger 62 of the first indoor unit 61 to the gas side and a tube extending from the second indoor heat exchanger 66 of the second indoor unit 65 to the gas side, and point Z, which is a merging point f a tube extending from one connection port of the first four-way switching valve 12 of the first outdoor unit 10 to the gas side and a tube extending from one connection port of the second four-way switching valve 22 of the second outdoor unit 20 to the gas side. The gas-side refrigerant interconnection tube 6 configures part of the refrigerant circuit 3.

The liquid-side refrigerant interconnection tube 5 and the gas-side refrigerant interconnection tube 6 extend from positions where the first outdoor unit 10 and the second outdoor unit 20 are installed to positions where the first indoor unit 61 and the second indoor unit 65 are installed, and these refrigerant interconnection tubes are the longest of the tubes configuring the refrigerant circuit 3.

(7) Air-Cooling Operation State

In the air-cooling operation state, the control unit 7 switches the connection states of the first four-way switching valve 12 and the second four-way switching valve 22 and executes a refrigeration cycle (refer to the connection states indicated by the dotted lines in the first four-way switching valve 12 and the second four-way switching valve 22 of FIG. 1) so that the first indoor heat exchanger 62 and the second indoor heat exchanger 66 function as refrigerant evaporators and the first outdoor heat exchanger 13 and the second outdoor heat exchanger 23 function as refrigerant heat radiators (condensers). Specifically, the control unit 7 performs a refrigeration cycle in which the connection state of the first four-way switching valve 12 causes the refrigerant discharged from the first compressor 11 to be channeled to the first outdoor heat exchanger 13 and some of the refrigerant flowing from the gas sides of the first indoor unit 61 and the second indoor unit 65 to be channeled to the intake side of the first compressor 11, and the connection state of the second four-way switching valve 22 causes the refrigerant discharged from the second compressor 21 to be channeled to the second outdoor heat exchanger 23 and the rest of the refrigerant flowing from the gas sides of the first indoor unit 61 and the second indoor unit 65 to be channeled to the intake side of the second compressor 21.

In the air-cooling operation state, the control unit 7 controls the first outdoor expansion valve 15 and the second outdoor expansion valve 25 so that both are fully open. The control unit 7 then performs control on the valve opening degrees of the first indoor expansion valve 64 and the second indoor expansion valve 68 so that the degree of superheating of the refrigerant flowing through the gas sides of the first indoor heat exchanger 62 and the second indoor heat exchanger 66 reaches a target degree of superheating.

The first compressor 11 and second compressor 21, the first indoor fan motor 63*a* and second indoor fan motor 67*a*, and/or the first outdoor fan motor 14*a* and second outdoor fan motor 24*a* are drivably controlled by the control unit 7 so that the drive frequencies thereof meet respective predetermined control conditions.

(8) Air-Warming Operation State

In the air-warming operation state, the control unit 7 switches the connection states of the first four-way switching valve 12 and the second four-way switching valve 22 and executes a refrigeration cycle (refer to the connection states indicated by the solid lines in the first four-way switching valve 12 and the second four-way switching valve 22 of FIG. 1) so that the first outdoor heat exchanger 13 and the second outdoor heat exchanger 23 function as refrigerant evaporators and the first indoor heat exchanger 62 and the second indoor heat exchanger 66 function as refrigerant heat radiators (condensers). Specifically, the control unit 7 performs a refrigeration cycle that causes the connection state of the first four-way switching valve 12 to be one in which the refrigerant flowing from the first outdoor heat exchanger 13 is channeled to the intake side of the first compressor 11 while the refrigerant discharged from the first compressor 11 becomes some of the refrigerant sent to the gas sides of the first indoor unit 61 and the second indoor unit 65, and the connection state of the second four-way switching valve 22 to be one in which the refrigerant flowing from the second outdoor heat exchanger 23 is channeled to the intake side of the second compressor 21 while the refrigerant discharged from the second compressor 21 becomes the rest of the refrigerant sent to the gas sides of the first indoor unit 61 and the second indoor unit 65. In the air-warming operation state, the control unit 7 performs control on the valve opening degrees of the first indoor expansion valve 64 and the second indoor expansion valve 68 so that the degree of supercooling of the refrigerant flowing through the liquid sides of the first indoor heat exchanger 62 and the second indoor heat exchanger 66 reaches a target degree of supercooling. The control unit 7 also performs control on the valve opening degrees of the first outdoor expansion valve 15 and the second outdoor expansion valve 25 so that the refrigerant sent to the first outdoor heat exchanger 13 and/or the second outdoor heat exchanger 23 can be decompressed.

The first compressor 11 and second compressor 21, the first indoor fan motor 63*a* and second indoor fan motor 67*a*, and/or the first outdoor fan motor 14*a* and second outdoor fan motor 24*a* are drivably controlled by the control unit 7 so that the drive frequencies meet respective predetermined control conditions.

(9) Defrost Operation

The control unit 7 performs a defrost operation when the control unit 7 determines that a predetermined defrosting condition has been fulfilled while the above-described air-warming operation is being performed.

There are no particular limitations as to the predetermined defrosting condition; for example, the condition can be that a state in which the outside air temperature and the temperature of an outdoor heat exchanger meet a predetermined temperature condition continues for at least a predetermined time. In this case, the control unit 7 may ascertain the outside air temperature from the temperature sensed by the first outside air temperature sensor 54 or the second outside air temperature sensor 59. Additionally, the control unit 7 may ascertain the temperature of an outdoor heat exchanger from the temperature sensed by the first outdoor heat exchanger temperature sensor 53 or the second outdoor heat exchanger temperature sensor 58. In the present embodiment, the control unit 7 is configured so that when the predetermined defrosting condition is fulfilled for either one or both the first outdoor heat exchanger 13 and the second outdoor heat exchanger 23, the control unit 7 performs the defrost operation (alternating defrost operation), in which all of the outdoor heat exchangers are designated in sequence as the outdoor heat exchangers to be defrosted.

In the defrost operation, the alternating defrost operation, which performs defrosting in all outdoor units, is performed by designating one of the plurality of outdoor units (the first outdoor unit 10 and the second outdoor unit 20) to be defrosted (partial defrost mode) and changing what is to be defrosted in sequence.

Specifically, in the alternating defrost operation, first, the connection states of the first four-way switching valve 12 and the second four-way switching valve 22 are switched so that only one heat exchanger between the first outdoor heat exchanger 13 and the second outdoor heat exchanger 23 is to be defrosted (e.g., so that the first outdoor heat exchanger 13 is to be defrosted), and defrosting of the outdoor heat exchanger that is to be defrosted (in this example, the first outdoor heat exchanger 13) is performed. When defrosting of the outdoor heat exchanger that is the first to be defrosted (in this example, the first outdoor heat exchanger 13) has ended, next, the connection states of the first four-way switching valve 12 and the second four-way switching valve 22 are switched so that only an outdoor heat exchanger (in this example, the second outdoor heat exchanger 23) other than the outdoor heat exchanger that was the first to be defrosted is to be defrosted, and defrosting of the outdoor heat exchanger that is the new heat exchanger to be defrosted (in this example, the second outdoor heat exchanger 23) is performed. Thus, defrosting of all of the outdoor heat exchangers is performed due to the connection states of the first four-way switching valve 12 and the second four-way switching valve 22 being switched so that the outdoor heat exchanger that is to be defrosted is changed in sequence (so as to rotate through the outdoor heat exchangers to be defrosted).

When defrosting of all of the outdoor heat exchangers has ended, the connection states of the first four-way switching valve 12 and the second four-way switching valve 22 are switched and the air-warming operation is once again restarted.

(9-1) Operation when the First Outdoor Heat Exchanger 13 is to be Defrosted

Figure 3:
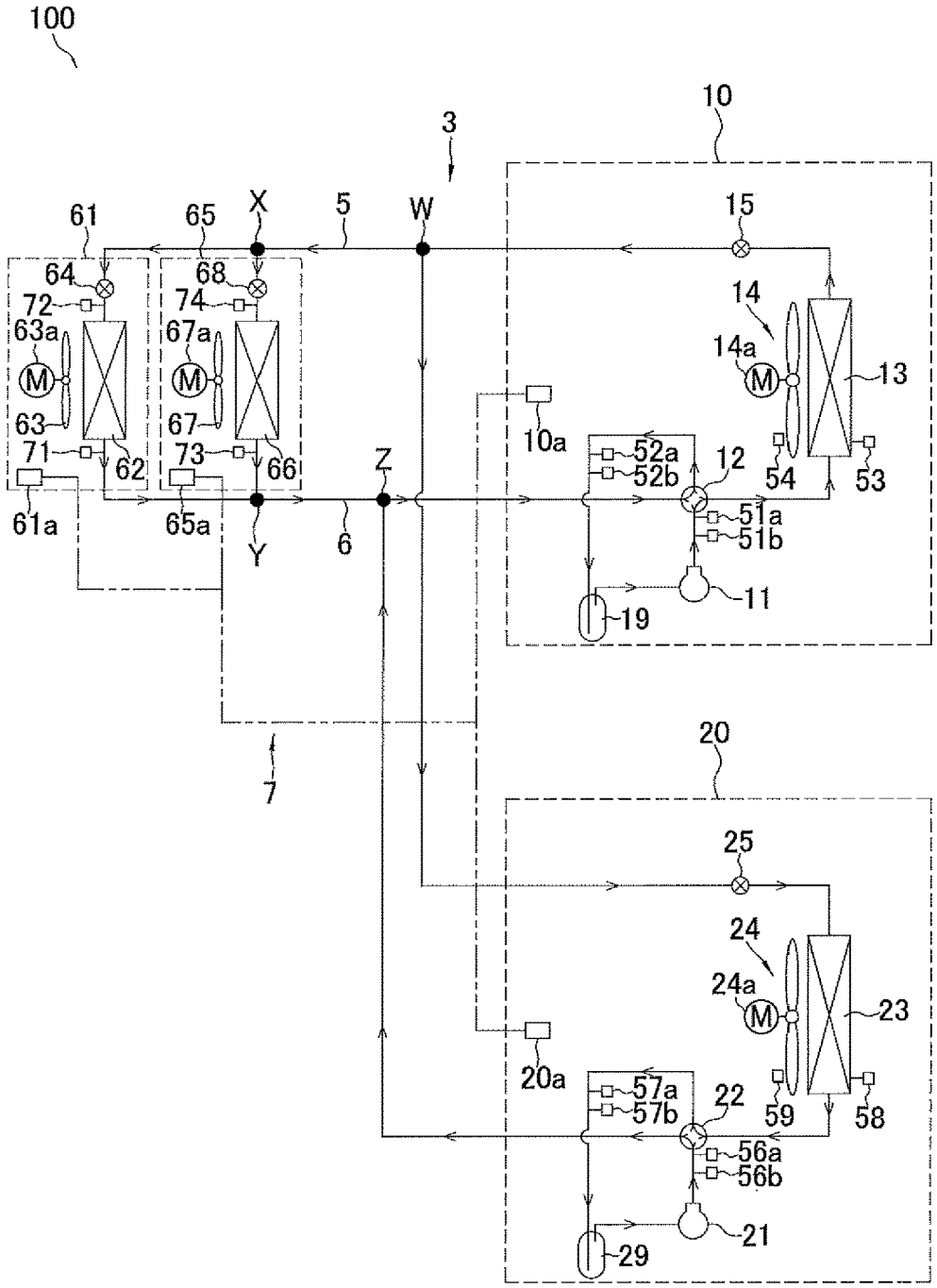
FIG. 3 shows how refrigerant flows when a first outdoor heat exchanger is to be defrosted.

FIG. 3 shows how refrigerant flows in the refrigerant circuit 3 when the connection states of the first four-way switching valve 12 and the second four-way switching valve 22 have been switched so that the above-described first outdoor heat exchanger 13 is to be defrosted.

When the first outdoor heat exchanger 13 is to be defrosted, the connection state of the first four-way switching valve 12 is switched so that the refrigerant passing through the portion of point Z of the refrigerant circuit 3 is channeled to the intake side of the first compressor 11 and the refrigerant discharged from the first compressor 11 is sent to the first outdoor heat exchanger 13, and the connection state of the second four-way switching valve 22 is switched so that the refrigerant that has passed through the second outdoor heat exchanger 23 is channeled to the intake side of the second compressor 21 and the refrigerant discharged from the second compressor 21 is sent to the portion of point Z of the refrigerant circuit 3.

At this point, the first outdoor expansion valve 15, which is provided to the liquid side of the first outdoor heat exchanger 13, which is to be defrosted, is controlled by the control unit 7 so that the valve opening degree comes to be fully open.

The valve opening degree of the second outdoor expansion valve 25, which is connected to the liquid side of the second outdoor heat exchanger 23, which is not to be defrosted, is controlled by the control unit 7 so that the degree of superheating of the refrigerant taken in by the second compressor 21 reaches a predetermined first target degree of superheating. The control unit 7 finds the degree of superheating of the refrigerant taken in by the second compressor 21 from the temperature sensed by the second intake temperature sensor 57*a* and the pressure sensed by the second intake pressure sensor 57*b*.

The first indoor expansion valve 64 and the second indoor expansion valve 68, as is described hereinafter, are not fully closed, but are both controlled to an opening degree that enables refrigerant to pass through. Additionally, the first indoor fan motor 63*a* and/or the second indoor fan motor 67*a* are basically stopped so that the cold air in the first indoor heat exchanger 62 and/or the second indoor heat exchanger 66 functioning as evaporators is not sent into the room.

In the operation state described above, the refrigerant that has passed through point W of the refrigerant circuit 3 is decompressed to a low pressure when passing through the second outdoor expansion valve 25, evaporated in the second outdoor heat exchanger 23 functioning as an evaporator of low-pressure refrigerant, and drawn into the second compressor 21 via the second four-way switching valve 22 and the second accumulator 29. Refrigerant compressed to an intermediate pressure in the second compressor 21 is sent to point Z of the refrigerant circuit 3 via the second four-way switching valve 22. At this point, as will be described hereinafter, because the first indoor expansion valve 64 and the second indoor expansion valve 68 are both controlled to an opening degree that enables refrigerant to pass through, refrigerant flows from the first indoor heat exchanger 62 and/or the second indoor heat exchanger 66 to the location of point Z of the refrigerant circuit 3 via the gas-side refrigerant interconnection tube 6. Therefore, at the location of point Z of the refrigerant circuit 3, the refrigerant merges and the merged refrigerant is taken into the first compressor 11 via the first four-way switching valve 12 and the first accumulator 19.

Refrigerant further compressed to a high pressure in the first compressor 11 becomes high-temperature and high-pressure refrigerant, which is supplied to the first outdoor heat exchanger 13, which is to be defrosted, and frost adhering to the first outdoor heat exchanger 13 can be efficiently melted. At this point, the first outdoor heat exchanger 13, which is to be defrosted, functions as a refrigerant heat radiator (condenser). High-pressure liquid refrigerant that has passed through the first outdoor heat exchanger 13 is sent to point W of the refrigerant circuit 3 after passing through the first outdoor expansion valve 15, which has been controlled to be fully open.

Because the first indoor expansion valve 64 and the second indoor expansion valve 68 have been opened, some of the high-pressure liquid refrigerant sent to point W of the refrigerant circuit 3 flows toward the first indoor heat exchanger 62 and the second indoor heat exchanger 66 via the liquid-side refrigerant interconnection tube 5 (the refrigerant is decompressed to an intermediate pressure in the first indoor expansion valve 64 and the second indoor expansion valve 68). At this point, the first indoor heat exchanger 62 and the second indoor heat exchanger 66 function as evaporators of the intermediate-pressure refrigerant. The refrigerant that has passed through the first indoor heat exchanger 62 and the second indoor heat exchanger 66 merges at point Y of the refrigerant circuit 3, after which the merged refrigerant is again sent to point Z of the refrigerant circuit 3 via the gas-side refrigerant interconnection tube 6. Additionally, the rest of the refrigerant sent to point W of the refrigerant circuit 3 is again sent to the second outdoor expansion valve 25.

In this manner is the operation performed in a case in which the first outdoor heat exchanger 13 is to be defrosted.

When a predetermined defrosting ending condition is fulfilled for the first outdoor heat exchanger 13, which is to be defrosted, i.e., when the temperature of a lower-end portion of this outdoor heat exchanger is equal to or greater than a predetermined temperature, the control unit 7 ends the defrosting of the first outdoor heat exchanger 13. To ascertain the temperature of the lower-end portion of the first outdoor heat exchanger 13, the control unit 7 may use the temperature sensed by the first outdoor heat exchanger temperature sensor 53, and should a temperature sensor separate from the first outdoor heat exchanger temperature sensor 53 be provided to this lower-end portion, the control unit 7 may use the temperature sensed by this temperature sensor.

Figure 4:
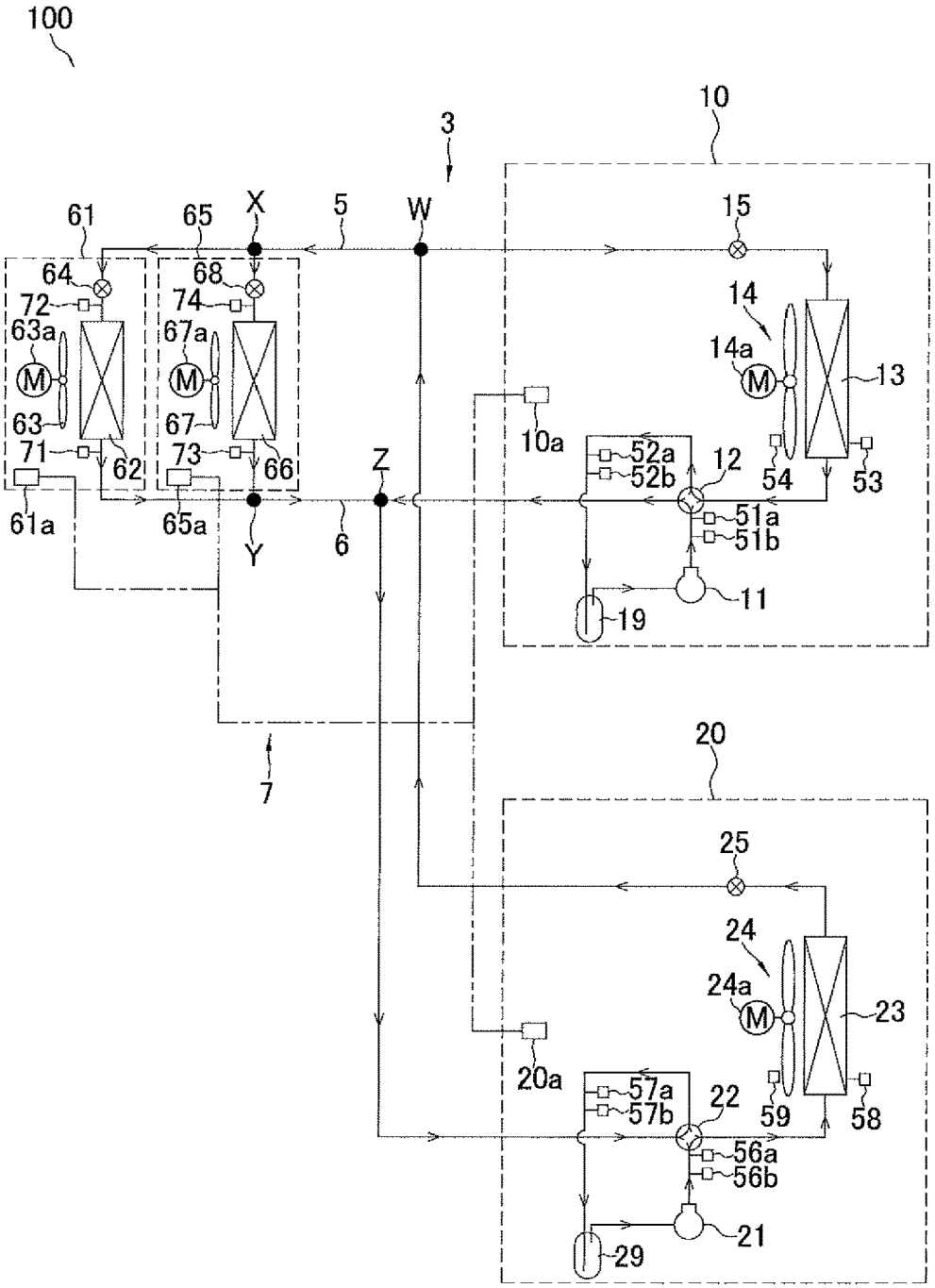
FIG. 4 shows how refrigerant flows when a second outdoor heat exchanger is to be defrosted.

(9-2) Operation when the Second Outdoor Heat Exchanger 23 is to be Defrosted FIG. 4 shows how refrigerant flows in the refrigerant circuit 3 when the connection states of the first four-way switching valve 12 and the second four-way switching valve 22 have been switched so that the above-described second outdoor heat exchanger 23 is to be defrosted.

When the second outdoor heat exchanger 23 is to be defrosted, the connection state of the first four-way switching valve 12 is switched so that the refrigerant has passed through the first outdoor heat exchanger 13 is channeled to the intake side of the first compressor 11 and the refrigerant discharged from the first compressor 11 is sent to portion of point Z of the refrigerant circuit 3, and the connection state of the second four-way switching valve 22 is switched so that the refrigerant that has passed through the portion of point Z of the refrigerant circuit 3 is channeled to the intake side of the second compressor 21 and the refrigerant discharged from the second compressor 21 is sent to the second outdoor heat exchanger 23.

At this point, the second outdoor expansion valve 25, which is provided to the liquid side of the second outdoor heat exchanger 23, which is to be defrosted, is controlled by the control unit 7 so that the valve opening degree comes to be fully open.

The valve opening degree of the first outdoor expansion valve 15, which is connected to the liquid side of the first outdoor heat exchanger 13, which is not to be defrosted, is controlled by the control unit 7 so that the degree of superheating of the refrigerant taken in by the first compressor 11 reaches the predetermined first target degree of superheating. The control unit 7 finds the degree of superheating of the refrigerant taken in by the first compressor 11 from the temperature sensed by the first intake temperature sensor 52*a* and the pressure sensed by the first intake pressure sensor 52*b*.

The first indoor expansion valve 64 and the second indoor expansion valve 68, as is described hereinafter, are not fully closed, but are both controlled to an opening degree that enables refrigerant to pass through. Additionally, the first indoor fan motor 63*a* and/or the second indoor fan motor 67*a* are basically stopped so that the cold air in the first indoor heat exchanger 62 and/or the second indoor heat exchanger 66 functioning as evaporators is not sent into the room.

In the operation state described above, the refrigerant that has passed through point W of the refrigerant circuit 3 is decompressed to a low pressure when passing through the first outdoor expansion valve 15, evaporated in the first outdoor heat exchanger 13 functioning as an evaporator of low-pressure refrigerant, and drawn into the first compressor 11 via the first four-way switching valve 12 and the first accumulator 19.

Refrigerant compressed to an intermediate pressure in the first compressor 11 is sent to point Z of the refrigerant circuit 3 via the first four-way switching valve 12. At this point, as will be described hereinafter, because the first indoor expansion valve 64 and the second indoor expansion valve 68 are both controlled to an opening degree that enables refrigerant to pass through, refrigerant flows from the first indoor heat exchanger 62 and/or the second indoor heat exchanger 66 to the location of point Z of the refrigerant circuit 3 via the gas-side refrigerant interconnection tube 6. Therefore, at the location of point Z of the refrigerant circuit 3, the refrigerant merges and the merged refrigerant is taken into the second compressor 21 via the second four-way switching valve 22 and the second accumulator 29.

Refrigerant further compressed to a high pressure in the second compressor 21 becomes high-temperature and high-pressure refrigerant, which is supplied to the second outdoor heat exchanger 23, which is to be defrosted, and frost adhering to the second outdoor heat exchanger 23 can be efficiently melted. At this point, the second outdoor heat exchanger 23, which is to be defrosted, functions as a refrigerant heat radiator (condenser). High-pressure liquid refrigerant that has passed through the second outdoor heat exchanger 23 is sent to point W of the refrigerant circuit 3 after passing through the second outdoor expansion valve 25, which has been controlled to be fully open.

Because the first indoor expansion valve 64 and the second indoor expansion valve 68 have been opened, some of the high-pressure liquid refrigerant sent to point W of the refrigerant circuit 3 flows toward the first indoor heat exchanger 62 and the second indoor heat exchanger 66 via the liquid-side refrigerant interconnection tube 5 (the refrigerant is decompressed to an intermediate pressure in the first indoor expansion valve 64 and the second indoor expansion valve 68). At this point, the first indoor heat exchanger 62 and the second indoor heat exchanger 66 function as evaporators of the intermediate-pressure refrigerant. The refrigerant that has passed through the first indoor heat exchanger 62 and the second indoor heat exchanger 66 merges at point Y of the refrigerant circuit 3, after which the merged refrigerant is again sent to point Z of the refrigerant circuit 3 via the gas-side refrigerant interconnection tube 6. Additionally, the rest of the refrigerant sent to point W of the refrigerant circuit 3 is again sent to the first outdoor expansion valve 15.

In this manner is the operation performed in a case in which the second outdoor heat exchanger 23 is to be defrosted.

When a predetermined defrosting ending condition is fulfilled for the second outdoor heat exchanger 23, which is to be defrosted, i.e., when the temperature of a lower-end portion of this outdoor heat exchanger is equal to or greater than a predetermined temperature, the control unit 7 ends the defrosting of the second outdoor heat exchanger 23. To ascertain the temperature of the lower-end portion of the second outdoor heat exchanger 23, the control unit 7 may use the temperature sensed by the second outdoor heat exchanger temperature sensor 58, and should a temperature sensor separate from the second outdoor heat exchanger temperature sensor 58 be provided to this lower-end portion, the control unit 7 may use the temperature sensed by this temperature sensor.

(10) Control Flow of Defrost Operation

Figure 5:
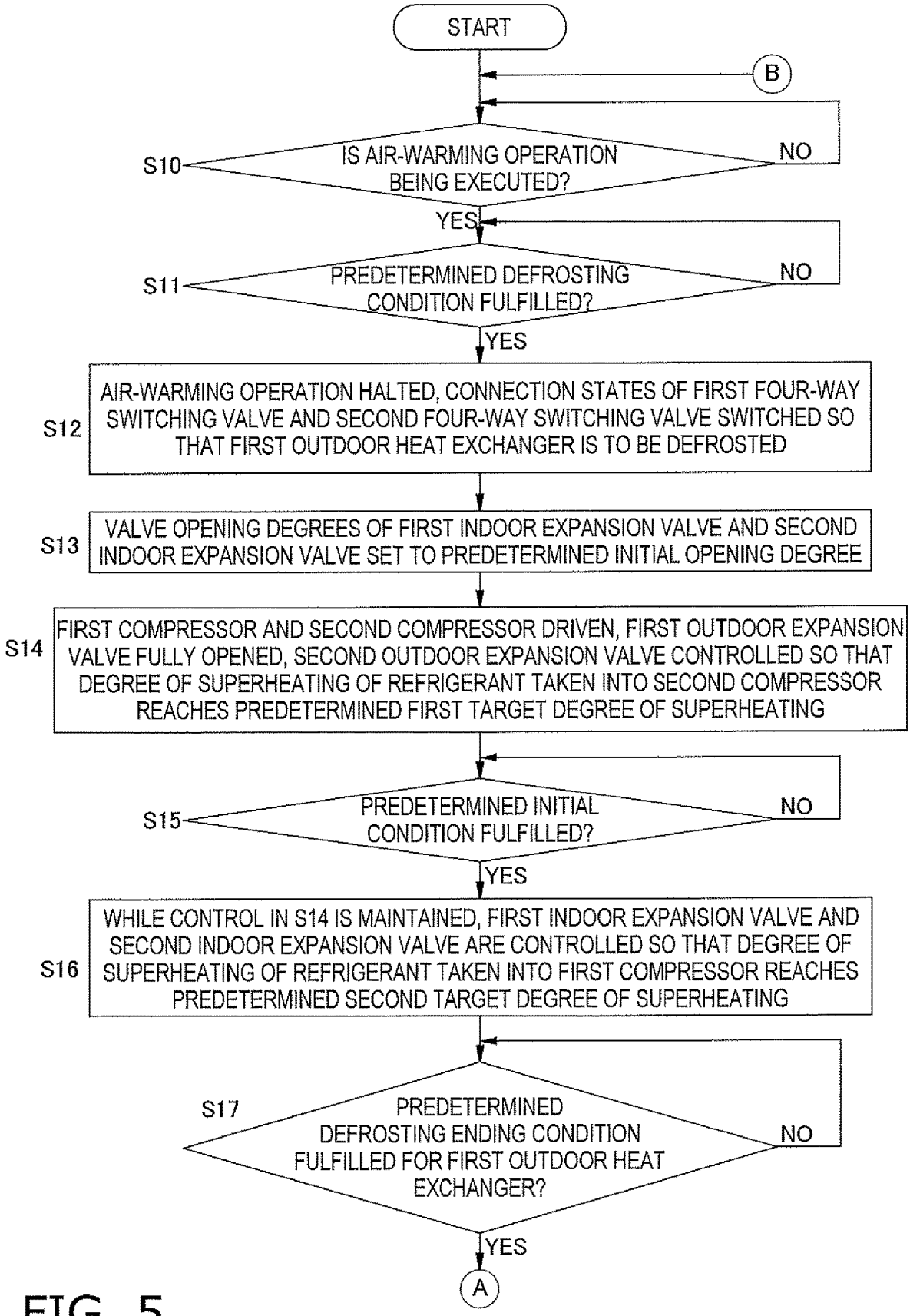
FIG. 5 is a flowchart (former half) of the defrost operation.
Figure 6:
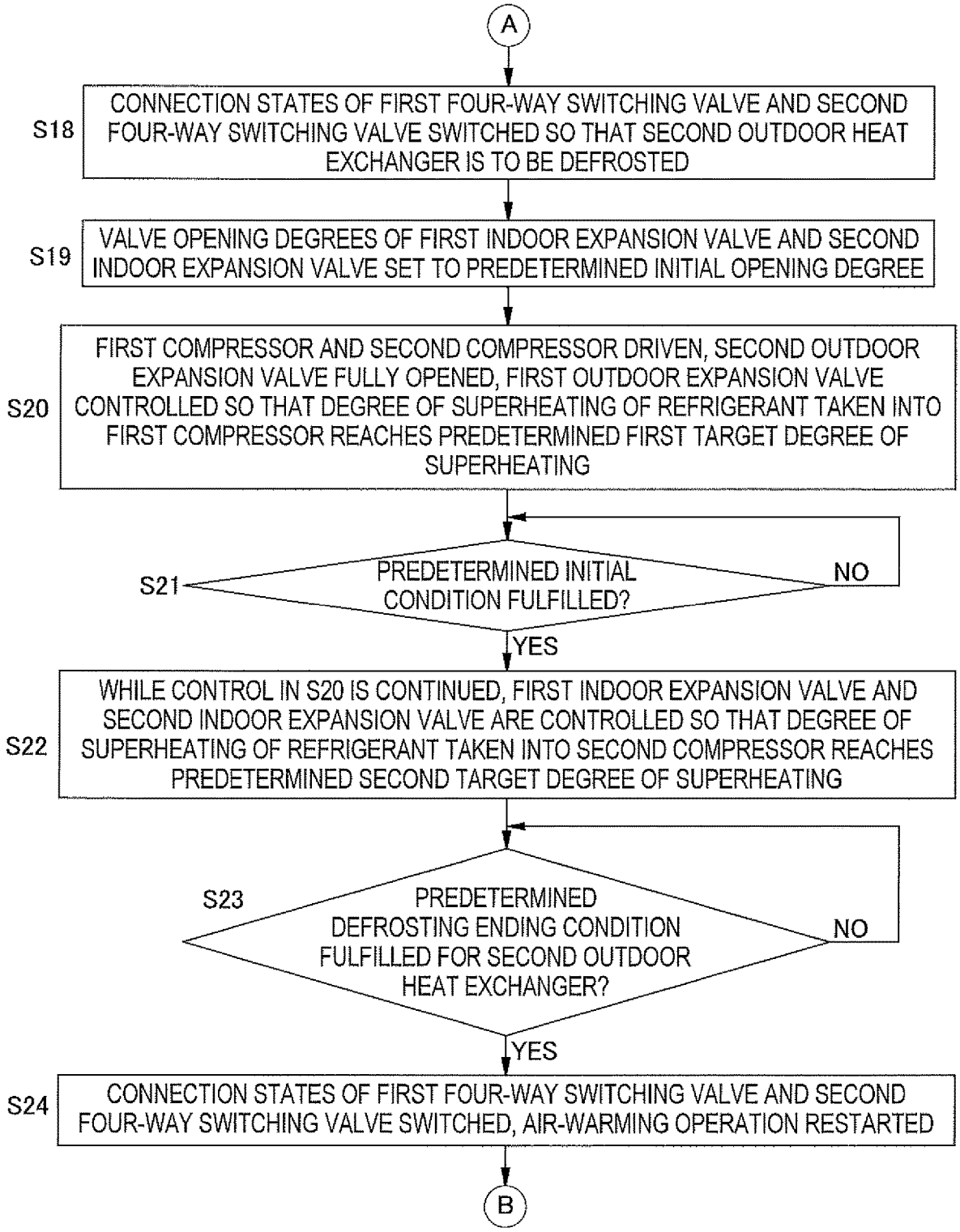
FIG. 6 is a flowchart (latter half) of the defrost operation.

FIGS. 5 and 6 show the control flow of the defrost operation.

In step S10, the control unit 7 determines whether or not the air-conditioning apparatus 100 is executing the air-warming operation. At this point, the process transitions to step S11 if the air-warming operation is being executed, and step S10 is repeated if the air-warming operation is not being executed.

In step S11, the control unit 7 determines whether or not the above-described predetermined defrosting condition has been fulfilled. Specifically, the control unit 7 transitions to step S12 when the predetermined defrosting condition has been fulfilled for at least one of the plurality of outdoor heat exchangers (the first outdoor heat exchanger 13 and the second outdoor heat exchanger 23), and repeats step S11 when the predetermined defrosting condition has not been fulfilled in any of the outdoor heat exchangers.

In step S12, the control unit 7 halts the air-warming operation and switches the connection states of the first four-way switching valve 12 and the second four-way switching valve 22 so that some of the plurality of outdoor heat exchangers are to be defrosted. There are no particular limitations as to the sequence of outdoor heat exchangers that will be the heat exchanger to be defrosted; in the present embodiment, the example described is of a case in which the first outdoor heat exchanger 13 is to be defrosted first and the second outdoor heat exchanger 23 is thereafter to be defrosted.

In step S13, the control unit 7 performs control so that the first indoor expansion valve 64 and the second indoor expansion valve 68 are opened and the valve opening degrees thereof are maintained at a predetermined initial opening degree. Specifically, the first indoor expansion valve 64 and the second indoor expansion valve 68 are not fully closed but are each ensured to be in a state such that refrigerant can pass through. There are no particular limitations as to the predetermined initial opening degree; for example, it may be a value corresponding to the capacities of the indoor heat exchangers to which the indoor expansion valves are directly connected, or, when the first indoor heat exchanger and the second indoor heat exchanger have different capacities, the predetermined initial opening degree may be set as a different opening degree according to the respective capacity of either indoor heat exchanger. Due to this configuration, from the initial state of the defrost operation, refrigerant flow in the refrigerant circuit 3 is facilitated and high-temperature and high-pressure refrigerant can be efficiently supplied to the outdoor heat exchanger/exchangers that is/are to be defrosted.

In step S14, the control unit 7 drives the first compressor 11 and the second compressor 21, fully opens the first outdoor expansion valve 15, and controls the second outdoor expansion valve 25 so that the degree of superheating of the refrigerant taken into the second compressor 21 reaches the predetermined first target degree of superheating (see FIG. 3 and the description thereof). There are no particular limitations as to the value of this first target degree of superheating; for example, it may be a value greater than 0 degrees and no more than 10 degrees, but is more preferably a value between 3 and 5 degrees, inclusive. In step S15, the control unit 7 determines whether or not a predetermined initial condition has been fulfilled. In this embodiment, there are no particular limitations as to the predetermined initial condition; for example, it may be a condition fulfilled when a predetermined initial time elapses from the time the first compressor 11 and the second compressor 21 start being driven while the first indoor expansion valve 64 and the second indoor expansion valve 68 have been set to the predetermined initial opening degree, or it may be a condition fulfilled when the degree of superheating of the refrigerant taken into the compressor (the first compressor 11 in this case) connected to the outdoor heat exchanger that is to be defrosted has reached a predetermined initial degree of superheating (e.g., 5 degrees or less). In this embodiment, the process transitions to step S16 if the predetermined initial condition has been fulfilled, and step S15 is repeated when the predetermined initial condition has not been fulfilled.

In step S16, while continuing the control in step S14, the control unit 7 stops the control maintaining the first indoor expansion valve 64 and the second indoor expansion valve 68 at the predetermined initial opening degree and performs control on the valve opening degrees of the first indoor expansion valve 64 and the second indoor expansion valve 68 so that the degree of superheating of the refrigerant taken into the first compressor 11 reaches a predetermined second target degree of superheating (indoor expansion valve opening degree adjustment mode). The value of the predetermined first target degree of superheating in step S14 and the value of the predetermined second target degree of superheating in step S16 may be the same value or different values. Presumably, in the stage of step S16, the refrigerant distribution in the refrigerant circuit 3 stabilizes as time elapses after the start of defrosting of the first outdoor heat exchanger 13, and liquid compression does not occur readily; therefore, the value of the second target degree of superheating of step S16 may be less than the value of the first target degree of superheating of step S14. It is thereby possible to execute degree of superheating control with precision.

In step S17, the control unit 7 determines whether or not the predetermined defrosting ending condition has been fulfilled for the outdoor heat exchanger that is currently the heat exchanger to be defrosted. In the example of the present embodiment, a determination is made as to whether or not the predetermined defrosting ending condition has been fulfilled for the first outdoor heat exchanger 13, which was to be defrosted at first. Specifically, as described above, the predetermined defrosting ending condition is determined to be fulfilled for the first outdoor heat exchanger 13 when the temperature of the lower-end portion of the first outdoor heat exchanger 13 is equal to or greater than the predetermined temperature. When the predetermined defrosting ending condition has been fulfilled, the process transitions to step S18 (see "A" of FIGS. 5 and 6), and when the predetermined defrosting ending condition has not been fulfilled, step S17 is repeated.

In step S18, the control unit 7 switches the connection states of the first four-way switching valve 12 and the second four-way switching valve 22 so that the outdoor heat exchanger that had up until then been the heat exchanger to be defrosted ceases to be the heat exchanger to be defrosted and an outdoor heat exchanger other than the outdoor heat exchanger that had up until then been the heat exchanger to be defrosted becomes the new heat exchanger to be defrosted. In the present embodiment, the connection states of the first four-way switching valve 12 and the second four-way switching valve 22 are switched so that the first outdoor heat exchanger 13, having finished defrosting, ceases to be the heat exchanger to be defrosted and the second outdoor heat exchanger 23 thereafter becomes the heat exchanger to be defrosted.

In step S19, similar to step S13, the control unit 7 performs control so that the first indoor expansion valve 64 and the second indoor expansion valve 68 are opened and the valve opening degrees are maintained at the predetermined initial opening degree. The predetermined initial opening degree of the first indoor expansion valve 64 and/or the second indoor expansion valve 68 during defrosting of the outdoor heat exchanger that is the first to be defrosted among the plurality of outdoor heat exchangers (step S13), and the predetermined initial opening degree of the first indoor expansion valve 64 and/or the second indoor expansion valve 68 during defrosting of the outdoor heat exchanger that is the second or later to be defrosted among the plurality of outdoor heat exchangers (step S19), may be the same or different. Should the predetermined initial opening degrees be different, for example, the predetermined initial opening degree of the first indoor expansion valve 64 and/or the second indoor expansion valve 68 during defrosting of the outdoor heat exchanger that is the second or later to be defrosted may be established so as to reflect the state of the refrigerant in the refrigerant circuit 3 at the end of defrosting of the outdoor heat exchanger that is the first to be defrosted (at the end of defrosting of the outdoor heat exchanger that had up until then been the heat exchanger to be defrosted).

In step S20, the control unit 7 drives the first compressor 11 and the second compressor 21, fully opens the second outdoor expansion valve 25, and controls the first outdoor expansion valve 15 so that the degree of superheating of the refrigerant taken into the first compressor 11 reaches the predetermined first target degree of superheating (see FIG. 4 and the description thereof). In this embodiment, the predetermined first target degree of superheating of step S20 can be, for example, a value greater than 0 degrees and no more than 10 degrees, and is preferably a value between 3 and 5 degrees, inclusive; it may be entirely the same value as or a different value from the predetermined first target degree of superheating of step S14.

In step S21, the control unit 7 determines whether or not a predetermined initial condition has been fulfilled. In this embodiment, there are no particular limitations as to the predetermined initial condition, as in step S15; for example, it may be a condition fulfilled when a predetermined initial time elapses from the time the first compressor 11 and the second compressor 21 start being driven while the first indoor expansion valve 64 and the second indoor expansion valve 68 have been set to the predetermined initial opening degree, or it may be a condition fulfilled when the degree of superheating of the refrigerant taken into the compressor (the second compressor 21 in this case) connected to the outdoor heat exchanger that is to be defrosted has reached a predetermined initial degree of superheating (e.g., 5 degrees or less). In this embodiment, the process transitions to step S22 if the predetermined initial condition has been fulfilled, and step S21 is repeated when the predetermined initial condition has not been fulfilled.

In step S22, while continuing the control in step S20, the control unit 7 stops the control maintaining the first indoor expansion valve 64 and the second indoor expansion valve 68 at the predetermined initial opening degree and performs control on the valve opening degrees of the first indoor expansion valve 64 and the second indoor expansion valve 68 so that the degree of superheating of the refrigerant taken into the second compressor 21 reaches the predetermined second target degree of superheating (indoor expansion valve opening degree adjustment mode). The value of the predetermined first target degree of superheating in step S20 and the value of the predetermined second target degree of superheating in step S22 may be the same value or different values. Presumably, in the stage of step S22, the refrigerant distribution in the refrigerant circuit 3 stabilizes as time elapses after the start of defrosting of the second outdoor heat exchanger 23, and liquid compression does not occur readily; therefore, the value of the second target degree of superheating of step S22 may be less than the value of the first target degree of superheating of step S20. It is thereby possible to execute degree of superheating control with precision.

In step S23, the control unit 7 determines whether or not the predetermined defrosting ending condition has been fulfilled for the outdoor heat exchanger that is currently the heat exchanger to be defrosted. In the example of the present embodiment, a determination is made as to whether or not the predetermined defrosting ending condition has been fulfilled for the second outdoor heat exchanger 23, which is to be defrosted after the first outdoor heat exchanger 13. Specifically, as described above, the predetermined defrosting ending condition is determined to be fulfilled for the second outdoor heat exchanger 23 when the temperature of the lower-end portion of the second outdoor heat exchanger 23 is equal to or greater than the predetermined temperature. When the predetermined defrosting ending condition has been fulfilled, the process transitions to step S24, and when the predetermined defrosting ending condition has not been fulfilled, step S23 is repeated.

In step S24, the control unit 7 switches the connection states of the first four-way switching valve 12 and the second four-way switching valve 22, which had made the second outdoor heat exchanger 23 the heat exchanger to be defrosted, to the connection states for performing the air-warming operation, restarts the air-warming operation, returns to step S10, and repeats the process (see "B" of FIGS. 6 and 5).

(11) Characteristics (11-1)

In the air-conditioning apparatus 100 of the present embodiment, when the predetermined defrosting condition is fulfilled, the alternating defrost operation is performed in which all of the outdoor heat exchangers are defrosted by setting one or some of the plurality of outdoor heat exchangers as a heat exchanger or exchangers to be defrosted and then changing what is to be defrosted. In this alternating defrost operation, an outdoor heat exchanger/exchangers other than that which is/are to be defrosted is/are caused to function as an evaporator of refrigerant at a low pressure and the indoor heat exchanger or exchangers is/are caused to function as evaporator or evaporators at an intermediate pressure, which is the pressure once the low-pressure refrigerant has been compressed (the pressure of the refrigerant compressed by the compressor connected to the outdoor heat exchanger or exchangers that is/are not the heat exchanger or exchangers to be defrosted), whereby the evaporation of refrigerant in the indoor heat exchanger or exchangers can be suppressed to a smaller amount in comparison with a case in which only the indoor heat exchanger or exchangers function as evaporator or evaporators of the refrigerant at a low pressure. Therefore, it is possible for the decrease in the indoor temperature during defrosting to be suppressed to a small decrease.

In the present embodiment, when the predetermined defrosting condition is fulfilled, all of the outdoor heat exchangers are defrosted by performing defrosting with the plurality of the outdoor heat exchangers designated as a heat exchanger or exchangers to be defrosted in sequence. Therefore, the frequency with which the air-warming operation is interrupted can be suppressed in comparison with when the air-warming operation is interrupted to perform the defrost operation every time there is an outdoor heat exchanger in which the predetermined defrosting condition has been fulfilled.

(11-2)

In this embodiment, the refrigerant amount sealed in the refrigerant circuit 3 of the air-conditioning apparatus 100 is only an amount that enables efficient operation when the air-cooling operation and/or the air-warming operation is performed using the indoor heat exchangers and the outdoor heat exchangers. However, there is likely to be excess refrigerant in the refrigerant circuit 3 in cases such as when heat for defrosting is obtained mainly in an outdoor unit or units other than the unit or units to be defrosted and defrosting is performed in an outdoor unit or units to be defrosted. By contrast, when the alternating defrost operation is performed in the air-conditioning apparatus 100 of the present embodiment, the first indoor expansion valve 64 and the second indoor expansion valve 68 are opened, and refrigerant can be channeled to the liquid-side refrigerant interconnection tube 5, the first indoor expansion valve 64, the second indoor expansion valve 68, the first indoor heat exchanger 62, the second indoor heat exchanger 66, and the gas-side refrigerant interconnection tube 6. Therefore, even when there is excess refrigerant, the excess refrigerant can be absorbed in these locations. Due to the excess refrigerant in the refrigerant circuit 3 being absorbed in these locations, it is possible to avoid situations in which refrigerant flowing out from the outdoor unit or units to be defrosted returns immediately to the same outdoor unit or units, and there is no need to employ a large accumulator for processing the excess refrigerant.

(11-3)

Moreover, the refrigerant flowing out from the outdoor unit or units to be defrosted can flow not only toward the outdoor unit or units that is/are not to be defrosted, but can also be caused to flow toward the indoor units (for example, when the first outdoor heat exchanger 13 is to be defrosted, even if the refrigerant that has passed through the first outdoor heat exchanger 13 would pass through point W and flow toward the second outdoor expansion valve 25, opening degree control corresponding to the degree of superheating of the refrigerant taken into the second compressor 21 is performed on the second outdoor expansion valve 25, and there are therefore cases in which the refrigerant cannot sufficiently pass through the second outdoor expansion valve 25; in these cases, the refrigerant that has passed through the first outdoor heat exchanger 13 can pass through point W and be caused to flow to the first indoor expansion valve 64 and/or the second indoor expansion valve 68 as well). Therefore, the pooling of liquid refrigerant in the outdoor heat exchanger or exchangers to be defrosted is suppressed and a state is created in which high-temperature refrigerant can be efficiently supplied, whereby defrosting can be efficiently performed.

(11-4)

Furthermore, due to the control unit 7 executing the indoor expansion valve opening degree adjustment mode, the first indoor expansion valve 64 and the second indoor expansion valve 68 are controlled so that the degree of superheating of the refrigerant taken into the compressor of the outdoor unit or units to be defrosted reaches the predetermined second target degree of superheating. Therefore, even when excess refrigerant is absorbed by opening the first indoor expansion valve 64 and/or the second indoor expansion valve 68 and channeling the refrigerant, the refrigerant amount sent to the outdoor unit or units to be defrosted from the first indoor unit 61 and/or the second indoor unit 65 can be controlled by controlling the opening degrees of the first indoor expansion valve 64 and the second indoor expansion valve 68. Therefore, it is possible to suppress the incidence of liquid compression and/or the incidence of abnormal increases in the discharged refrigerant temperature in the compressor of the outdoor unit or units that has the outdoor heat exchanger to be defrosted. Additionally, even if refrigerant is sent to the outdoor unit or units to be defrosted not only from the first indoor unit 61 and/or the second indoor unit 65 but also from the outdoor unit or units that is/are not to be defrosted, such degree of superheating control of the first indoor expansion valve 64 and the second indoor expansion valve 68 makes it possible to suppress liquid compression and/or abnormal increases of the discharged refrigerant temperature in the compressor of the outdoor unit or units to be defrosted.

(11-5)

In the present embodiment, from the start of the alternating defrost operation until the predetermined initial condition is fulfilled (until a time before degree of superheating control of the first indoor expansion valve 64 and the second indoor expansion valve 68 is started), the valve opening degrees of the first indoor expansion valve 64 and the second indoor expansion valve 68 are maintained at the predetermined initial opening degree. Therefore, immediately after the start of the alternating defrost operation, a reliable flow of refrigerant can be ensured in the peripheries of the first indoor unit 61 and/or the second indoor unit 65, and accumulation of refrigerant in the outdoor heat exchanger to be defrosted can be effectively suppressed.

(11-6)

In the present embodiment, when the alternating defrost operation is performed, refrigerant can be compressed in multiple stages, with the compressor of the outdoor unit or units that is/are not to be defrosted as the low-stage-side compressor and the compressor of the outdoor unit or units that is/are to be defrosted as the high-stage-side compressor. Because high-temperature refrigerant thus compressed in multiple stages can be supplied to the outdoor heat exchanger or exchangers that is/are to be defrosted, defrosting can be performed efficiently.

(12) Other Embodiments

In the above embodiment, an example of an embodiment of the present invention was described, but the above embodiment is in no way intended to limit the present invention, nor is the above embodiment provided by way of limitation. The present invention naturally includes forms that have been appropriately modified without deviating from this intention.

(12-1) Other Embodiment A

In the above embodiment, a case in which two outdoor units are connected in parallel to an indoor unit was described as an example.

Conversely, for example, the number of outdoor units connected in parallel to an indoor unit is not limited to two; for example, three or more outdoor units may be connected in parallel to an indoor unit.

In this case, when alternating defrosting is performed, all of the outdoor heat exchangers may be defrosted by setting one outdoor heat exchanger as the heat exchanger to be defrosted and changing the one outdoor heat exchanger that is to be defrosted. Another option is to defrost all of the outdoor heat exchangers by setting a plurality of outdoor heat exchangers as heat exchangers to be defrosted and changing the plurality of outdoor heat exchangers to be defrosted.

(12-2) Other Embodiment B

In the above embodiment, an example was described in which, when the predetermined defrosting condition is fulfilled for either one or both the first outdoor heat exchanger 13 and the second outdoor heat exchanger 23, all of the outdoor heat exchangers are designated as heat exchangers to be defrosted in sequence.

Conversely, for example, the control unit 7 may perform control so that only those outdoor heat exchangers, among the plurality of outdoor heat exchangers, for which the predetermined defrosting condition has been fulfilled are operated so as to be defrosted, and other outdoor heat exchangers for which the predetermined defrosting condition has not been fulfilled are not defrosted until the predetermined defrosting condition is fulfilled for those outdoor heat exchangers. Specifically, each outdoor heat exchanger may be defrosted only when the predetermined defrosting condition has been fulfilled for the same outdoor heat exchanger.

Even in this case, it is possible to achieve the same effects as those of the above embodiment, which are achieved by opening the indoor expansion valves.

(12-3) Other Embodiment C

In the above embodiment, an example was described of a case in which, in steps S14, S16, S20, and S22, opening degree control of the expansion valves is performed so that the degree of superheating of the refrigerant taken in by a compressor reaches a predetermined target value.

Conversely, for example, in the above-listed steps, opening degree control for the expansion valves may be performed so that the degrees of superheating of the refrigerant discharged from the compressors, rather than the degrees of superheating of the refrigerant taken in by the compressors, reaches a predetermined target value. There would be no particular limitations as to the degrees of superheating of the refrigerant discharged from the compressors in this case; for example, the degrees of superheating may be found by the control unit 7 from the temperature sensed by the first discharge temperature sensor 51*a* and the pressure sensed by the first discharge pressure sensor 51*b*, or they may be found by the control unit 7 from the temperature sensed by the second discharge temperature sensor 56*a* and the pressure sensed by the second discharge pressure sensor 56*b*.

INDUSTRIAL APPLICABILITY

The refrigeration apparatus described above is particularly useful as a refrigeration apparatus in which a plurality of outdoor units are provided, because even when defrosting is performed with some of the plurality of outdoor units designated as units to be defrosted, adverse events caused by excess refrigerant can be suppressed.

REFERENCE SIGNS LIST

3 Refrigerant circuit
7 Control unit
10 First outdoor unit (outdoor unit)
10*a* First outdoor-side control board (control unit)
11 First compressor (compressor)
12 First four-way switching valve (switching valve)
13 First outdoor heat exchanger (outdoor heat exchanger)
15 First outdoor expansion valve (outdoor expansion valve)
20 Second outdoor unit (outdoor unit)
20*a* Second outdoor-side control board (control unit)
21 Second compressor (compressor)
22 Second four-way switching valve (switching valve)
23 Second outdoor heat exchanger (outdoor heat exchanger)
25 Second outdoor expansion valve (outdoor expansion valve)
61 First indoor unit (indoor unit)
61*a* First indoor-side control board (control unit)
62 First indoor heat exchanger (indoor heat exchanger)
64 First indoor expansion valve (indoor expansion valve)
65 Second indoor unit (indoor unit)
65*a* Second indoor-side control board (control unit)
66 Second indoor heat exchanger (indoor heat exchanger)
68 Second indoor expansion valve (indoor expansion valve)
100 Air-conditioning apparatus (refrigeration apparatus)

CITATION LIST

Patent Literature

[Patent Literature 1] Japanese Laid-open Patent Publication No. 2008-25919

The invention claimed is:

1. A refrigeration apparatus configured from a parallel connection of a plurality of outdoor units to an indoor unit, the refrigeration apparatus comprising:

a refrigerant circuit configured from a connection of:
- an indoor heat exchanger and an indoor expansion valve provided to the indoor unit; and
- outdoor heat exchangers, compressors, and switching valves provided to the respective outdoor units; and a controller configured with a partial defrost mode in which an operation is performed with the switching valves having been switched so that the outdoor heat exchangers of some of the plurality of outdoor units are caused to function as condensers while the outdoor heat exchangers of the rest of the plurality of outdoor units are caused to function as evaporators, whereby the outdoor heat exchangers functioning as the condensers are designated as components to be defrosted, the refrigerant circuit, during execution of the partial defrost mode, having a flow channel that supplies some of the refrigerant flowing out of the outdoor heat exchangers functioning as condensers to the outdoor heat exchangers functioning as evaporators, and a flow channel that supplies the rest of the refrigerant flowing out of the outdoor heat exchangers functioning as condensers to the indoor heat exchanger, wherein the refrigerant circuit, during execution of the partial defrost mode, has a flow channel that supplies refrigerant that has passed through the indoor heat exchanger to intake sides of the compressors of the outdoor units having the outdoor heat exchangers functioning as condensers, and the controller is further configured to execute an indoor expansion valve opening degree adjustment mode of performing opening degree control for the indoor expansion valve so that a degree of superheating of refrigerant in the compressors of the outdoor units having the outdoor heat exchangers functioning as condensers meets a predetermined degree of superheating condition.

2. The refrigeration apparatus according to claim 1, wherein the controller is further configured to perform control that fixes the opening degree of the indoor expansion valve at a predetermined opening degree from the time the partial defrost mode starts until a time before the start of the indoor expansion valve opening degree adjustment mode.

3. The refrigeration apparatus according to claim 1, wherein the refrigerant circuit, during execution of the partial defrost mode, has a flow channel that supplies refrigerant that has passed through the outdoor heat exchangers functioning as evaporators to the intake sides of the compressors of the outdoor units having the outdoor heat exchangers functioning as condensers via the compressors of the outdoor units having the outdoor heat exchangers functioning as evaporators.

4. The refrigeration apparatus according to claim 1, wherein when a predetermined defrosting ending condition has been fulfilled for the outdoor heat exchangers to be defrosted, the controller is configured to switch the switching valves and perform an operation so that the outdoor heat exchangers that had been designated to be defrosted are caused to function as evaporators while the designation of outdoor heat exchangers to be defrosted is changed to other outdoor heat exchangers.

5. The refrigeration apparatus according to claim 2, wherein the refrigerant circuit, during execution of the partial defrost mode, has a flow channel that supplies refrigerant that has passed through the outdoor heat exchangers functioning as evaporators to the intake sides of the compressors of the outdoor units having the outdoor heat exchangers functioning as condensers via the compressors of the outdoor units having the outdoor heat exchangers functioning as evaporators.

6. The refrigeration apparatus according to claim 2, wherein when a predetermined defrosting ending condition has been fulfilled for the outdoor heat exchangers to be defrosted, the controller is configured to switch the switching valves and perform an operation so that the outdoor heat exchangers that had been designated to be defrosted are caused to function as evaporators while the designation of outdoor heat exchangers to be defrosted is changed to other outdoor heat exchangers.

7. The refrigeration apparatus according to claim 3, wherein when a predetermined defrosting ending condition has been fulfilled for the outdoor heat exchangers to be defrosted, the controller is configured to switch the switching valves and perform an operation so that the outdoor heat exchangers that had been designated to be defrosted are caused to function as evaporators while the designation of outdoor heat exchangers to be defrosted is changed to other outdoor heat exchangers.

8. The refrigeration apparatus according to claim 5, wherein when a predetermined defrosting ending condition has been fulfilled for the outdoor heat exchangers to be defrosted, the controller is configured to switch the switching valves and perform an operation so that the outdoor heat exchangers that had been designated to be defrosted are caused to function as evaporators while the designation of outdoor heat exchangers to be defrosted is changed to other outdoor heat exchangers.

* * * * *